US010415223B2

(12) United States Patent
Chen et al.

(10) Patent No.: US 10,415,223 B2
(45) Date of Patent: Sep. 17, 2019

(54) ELECTRONIC TOILET SWITCHABLE BETWEEN COLD WATER AND HOT WATER AND METHOD OF CONTROLLING THE SAME

(71) Applicant: HANYU GROUP JOINT-STOCK CO., LTD., Guangdong (CN)

(72) Inventors: Shuping Chen, Guangdong (CN); Huashan Shi, Guangdong (CN); Yong Luo, Guangdong (CN)

(73) Assignee: HANYU GROUP JOINT-STOCK CO., LTD., Jiangmen, Guangdong (CN)

( * ) Notice: Subject to any disclaimer, the term of this patent is extended or adjusted under 35 U.S.C. 154(b) by 0 days.

(21) Appl. No.: 15/576,479

(22) PCT Filed: May 26, 2016

(86) PCT No.: PCT/CN2016/083411

§ 371 (c)(1),
(2) Date: Nov. 30, 2017

(87) PCT Pub. No.: WO2016/188441

PCT Pub. Date: Dec. 1, 2016

(65) Prior Publication Data

US 2018/0163385 A1 Jun. 14, 2018

(30) Foreign Application Priority Data

May 26, 2015 (CN) ..... 2015 2 0344987 U
Dec. 16, 2015 (CN) ..... 2015 2 1054366 U

(51) Int. Cl.

| | |
|---|---|
| ***E03D 9/08*** | (2006.01) |
| ***E03D 11/02*** | (2006.01) |
| ***E03D 9/05*** | (2006.01) |
| ***F24H 1/20*** | (2006.01) |
| ***F24H 9/18*** | (2006.01) |

(52) U.S. Cl.
CPC ..... *E03D 9/08* (2013.01); *E03D 9/05* (2013.01); *E03D 11/02* (2013.01); *E03D 2201/40* (2013.01); *F24H 1/207* (2013.01); *F24H 9/1809* (2013.01)

(58) Field of Classification Search
CPC ..... E03D 9/08; E03D 2201/40
USPC ..... 4/491
See application file for complete search history.

(56) References Cited

U.S. PATENT DOCUMENTS

| | | | | |
|---|---|---|---|---|
| 7,120,946 | B1 | 10/2006 | Lazar | |
| 2004/0060107 | A1* | 4/2004 | Eisenberg | A47K 7/046 4/605 |
| 2011/0179564 | A1 | 7/2011 | Yao | |

FOREIGN PATENT DOCUMENTS

| | | |
|---|---|---|
| CN | 201206919 | 3/2009 |
| CN | 102650143 | 8/2012 |
| CN | 204690884 | 10/2015 |
| JP | 2001061705 | 3/2001 |

* cited by examiner

*Primary Examiner* — Lori L Baker
(74) *Attorney, Agent, or Firm* — Boyle Fredrickson S.C.

(57) ABSTRACT

An electronic toilet and method of controlling the electronic toilet. The electronic toilet is connected to a cold water supply and a hot water supply and includes a controller that is configured to allow the electronic toilet to communicate cold water and/or hot water to a water straying cleaner that directed toward the anus of a user of the toilet.

26 Claims, 13 Drawing Sheets

ELECTRONIC TOILET SWITCHABLE BETWEEN COLD WATER AND HOT WATER AND METHOD OF CONTROLLING THE SAME

TECHNICAL FIELD

The present invention belongs to the technical field of electronic toilets, and particularly to an electronic toilet for treating hemorrhoids and a method of controlling the same.

BACKGROUND ART

An existing electronic toilet can achieve rectum flushing, anus cleaning and flushing, and water discharged therefrom is supplied from a hot water tank. The hot water tank forms a circulating waterway together with a circulating water pump and a seat. The temperature of the flushing water is achieved by controlling the work of a heating tube of the hot water tank. When the water temperature is adjusted from a high temperature to a low temperature by a user, such a temperature reduction can be achieved by the system only after discharging high-temperature hot water in the hot water tank through a spray bar first and then replenishing cold water, or after natural cooling of the water in the hot water tank. Both methods fail to realize rapid reduction of the water temperature.

SUMMARY OF THE INVENTION

A first objective of the present invention is to provide an electronic toilet switchable between cold water and hot water.

A second objective of the present invention is to provide a method of controlling an electronic toilet switchable between cold water and hot water. A first electronic toilet switchable between cold water and hot water in the present invention includes: a controller, a water spraying cleaner, a cold-water pipe for supplying cold water, a hot-water pipe for supplying hot water, a cold water electromagnetic valve disposed on the cold-water pipe, a hot water electromagnetic valve disposed on the hot-water pipe, and a switching unit for controlling cold water in the cold-water pipe and/or hot water in the hot-water pipe to be sprayed via the water spraying cleaner.

Preferably, the switching unit is a booster pump connected between the water outlet of the water selector valve and the water spraying cleaner via a pipe, or a water inlet valve for connecting/disconnecting the cold-water pipe and/or the hot-water pipe.

A second electronic toilet switchable between cold water and hot water in the present invention includes: a controller; a water spraying cleaner; a cold-water pipe for supplying cold water; a hot-water pipe for supplying hot water, a water selector valve for receiving and discharging cold water from the cold-water pipe or receiving and discharging hot water from the hot-water pipe under the control of the controller, the water selector valve having a hot-water inlet connected to the hot-water pipe, a cold-water inlet connected to the cold-water pipe, and a water outlet for discharging cold water or hot water, and a booster pump connected between the water outlet of the water selector valve and the water spraying cleaner via a pipe and controlled by the controller.

A third electronic toilet switchable between cold water and hot water in the present invention includes: a controller; a water spraying cleaner; a cold-water pipe for supplying cold water; a hot-water pipe for supplying hot water; a cold water one-way booster pump unit connected to the cold-water pipe and controlled by the controller; and a hot water one-way booster pump unit connected to the hot-water pipe and controlled by the controller, wherein the water spraying cleaner communicates with a water outlet of the cold water one-way booster pump unit and a water outlet of the hot water one-way booster pump unit.

Preferably, the above cold water one-way booster pump unit includes a cold-water booster pump connected with a water inlet thereof to the cold-water outlet pipe and controlled by the controller, and a cold-water check valve connected with a water inlet thereof to a water outlet of the cold-water booster pump. The above hot water one-way booster pump unit includes a hot water booster pump connected with a water inlet thereof to the hot water outlet pipe and controlled by the controller, and a hot water check valve connected with a water inlet thereof to a water outlet of the hot water booster pump, wherein a water outlet of the cold-water check valve and a water outlet of the hot water check valve are connected to a water inlet of the water spraying cleaner via pipes.

Preferably, the above cold-water pipe and the hot-water pipe are connected to an external cold-water source and an external hot water source, respectively. Preferably, the above cold-water pipe is connected to the external cold-water source or connected to an external water source via a non-chilling cold-water tank; and the hot-water pipe is connected to the external water source via a water heater for producing hot water.

Preferably, the electronic toilet in the present invention also includes: a water heater connected between the external cold-water source and the hot-water pipe to produce hot water, and a water chiller connected between the external hot water source and the cold-water pipe to produce cold water.

Preferably, the water chiller in the present invention includes: a cold-water tank which contains the cold water therein; a sensor installed in or outside the cold-water tank to directly or indirectly detect a temperature of cold water in the cold-water tank; and a chiller having a chilling part installed in or outside the cold-water tank and configured to directly or indirectly chill the cold water in the cold-water tank.

Preferably, the above chiller is a semiconductor chilling plate including a radiating surface and a chilling surface, with the chilling surface being installed in the cold-water tank or pressed against an outer wall of the cold-water tank as the chilling part. The radiating surface of the semiconductor chilling plate communicates with the water heater to transfer heat to hot water in the water heater.

Preferably, the above chiller also includes a radiating fin installed in the cold-water tank and pressed against the chilling surface of the semiconductor chilling plate for cold energy conduction.

Preferably, the above chiller is a chilling system including a compressor, an evaporator and a condenser, and the evaporator thereof is installed in the cold-water tank or pressed against the outer wall of the cold-water tank as the chilling part.

Preferably, the above water heater includes: a hot water tank; a heating element installed in or outside the hot water tank; a temperature sensor installed in the hot water tank; and a water level switch installed in the hot water tank.

Preferably, the above heating element includes the condenser of the chilling system that is installed in the hot water tank or pressed against an outer wall of the hot water tank. Besides, the heating element may also include a heating tube installed in the hot water tank.

Preferably, a heat sink is disposed between a pipe connecting to the hot water tank and a pipe connecting to a seat having a water receiving cavity, the heat sink comprising a radiator and a fan.

Preferably, the above water selector valve includes: a valve body having the cold-water inlet, the hot-water inlet and the water outlet; and an electrically driven opening-closing component installed in the valve body and controlled by the controller to open the hot-water inlet when closing the cold-water inlet or open the cold-water inlet when closing the hot-water inlet.

Preferably, the water selector valve includes: a valve body having the cold-water inlet, the hot-water inlet and the water outlet; and an electrically driven opening-closing component installed in the valve body and controlled by the controller to open the hot-water inlet when closing the cold-water inlet or open the cold-water inlet when closing the hot-water inlet. The electrically driven opening-closing component includes: a drive element installed on the valve body and controlled by the controller, and a valve spool installed in a cavity of the valve body and driven by the drive element. The valve spool has a closing part for closing the cold-water inlet or the hot-water inlet.

The present invention provides two methods of controlling the electronic toilet to be switchable between cold water and hot water. An electronic toilet to which the first method is applicable includes: a cold-water pipe for supplying cold water, a hot-water pipe for supplying hot water; a water selector valve for selecting water supply from the cold-water pipe and the hot-water pipe, a switching unit for controlling cold water in the cold-water pipe or hot water in the hot-water pipe to be sprayed via a water spraying cleaner, the water spraying cleaner for cleaning anus with hot water or cold water supplied from the water selector valve, and a controller for controlling the water selector valve and the switching unit.

The first method of controlling an electronic toilet switchable between cold water and hot water in the present invention includes the following steps: the controller obtaining a temperature of cold water supplied from the cold-water pipe when receiving a cleaning instruction from a user; the controller determining open time and close time for the switching unit according to the obtained temperature of cold water; the controller controlling the switching unit to be opened according to the determined open time for the switching, allowing cold water from the cold-water pipe to be sprayed via the water spraying cleaner, and the controller rendering the switching unit closed according to the determined close time for the switching unit after expiration of the open time for the switching unit, to prevent cold water or hot water from being sprayed via the water spraying cleaner.

Preferably, the step of the controller determining the open time and the close time for the switching unit according to the obtained temperature of cold water includes: the controller obtaining the temperature of cold water according to information of detecting the temperature of cold water from a temperature sensor; and the controller determining the open time and the close time for the switching unit that correspond to the temperature of cold water by looking up a prestored correspondence list containing a correspondence of temperatures of water, and open time and close time for the switching unit.

Preferably, the lower the temperature of cold water is, the shorter the open time and the close time of the switching unit are.

Preferably, the temperature of cold water is greater than or equal to 0° C. and less than or equal to 43° C.

Preferably, the correspondence of temperatures of water, and open time and close time for the switching unit in the correspondence list includes:

| Temperature of Cold-Water (° C.) | Pressure Boost Operating Time for Booster Pump (S) | Stop Time for Booster Pump (S) |
|---|---|---|
| 0-7.9 | 5 ± 10% | 2 ± 10% |
| 8-9.9 | 6 ± 10% | 3 ± 10% |
| 10-11.9 | 7 ± 10% | 4 ± 10% |
| 12-13.9 | 8 ± 10% | 5 ± 10% |
| 14-15.9 | 9 ± 10% | 5 ± 10% |
| 16-17.9 | 10 ± 10% | 5 ± 10% |
| 18-43 | 15 ± 10% | 5 ± 10% |

Preferably, the switching unit is a booster pump connected between the water outlet of the water selector valve and the water spraying cleaner via a pipe, and the open time for the switching unit is operating time for the booster pump while the close time for the switching unit is stop time for the booster pump.

An electronic toilet to which a second method of the present invention is applicable includes: a cold-water pipe for supplying cold water; a hot-water pipe for supplying hot water, a switching unit for controlling the cold-water pipe and/or the hot-water pipe to supply water, a water selector valve for selecting water supply from the cold-water pipe and the hot-water pipe; a water spraying cleaner for cleaning anus with hot water or cold water selected by the water selector valve; and a controller for controlling the water selector valve and the switching unit.

The second method of controlling an electronic toilet switchable between cold water and hot water in the present invention includes the following steps: the controller controlling the switching unit to allow the cold-water pipe and/or the hot-water pipe to supply water when receiving an anus cleaning instruction from a user, the controller controlling the water selector valve to alternately discharge cold water from the cold-water pipe and hot water from the hot-water pipe during water supply from the cold-water pipe and/or the hot-water pipe, such that the water spraying cleaner alternately sprays cold water and hot water, and the controller controlling the switching unit to stop the cold-water pipe and the hot-water pipe from supplying water after the water selector valve alternately discharges cold water and hot water for a number of times.

Preferably, the switching unit is a booster pump connected between the water outlet of the water selector valve and the water spraying cleaner via a pipe. Preferably, the controller enables the cold-water pipe and/or the hot-water pipe to supply water by controlling the switching unit when receiving an anus cleaning instruction from a user Preferably, the step that the controller enables the cold-water pipe and/or the hot-water pipe to supply water by controlling the switching unit when receiving an anus cleaning instruction from a user includes: the controller controlling the water selector valve to receive and discharge cold water from the cold-water pipe and controlling the cleaner to stretch out according to the anus cleaning instruction; and the controller enabling the booster pump to perform a pressure boost operation after the cleaner is stretched out, so that the cold water is sprayed via the water spraying cleaner.

Preferably, the controller controls the water selector valve to alternately discharge cold water and hot water during water supply from the cold-water pipe and/or the hot-water pipe, which specifically includes: the controller starting a timer when cold water is sprayed via the water spraying cleaner; the controller controlling the water selector valve to disconnect the cold-water pipe and connect the hot-water pipe according to timing expiration information of the timer, allowing hot water from the hot-water pipe to be sprayed via the water spraying cleaner, and the controller starting again the timer when hot water is sprayed via the water spraying cleaner, and controlling the water selector valve to receive and discharge cold water from the cold-water pipe, allowing the cold water to be sprayed via the water spraying cleaner, thereby achieving alternate spray of cold water and hot water via the water spraying cleaner.

Preferably, when cold water from a water chiller is supplied by the cold-water pipe, the controller detects the temperature of cold water in a cold-water tank by means of a temperature sensor installed in the cold water tank, and controls a chiller to chill the water in the cold-water tank according to a detection result.

Preferably, the controller controls the chiller to chill the water in the cold-water tank according to the detection result, which specifically includes: determining whether the detected temperature of cold water is below a first temperature; stopping the chilling operation of the chiller in the event of the temperature of cold water below the first temperature; determining whether temperature of cold water is above a second temperature in the event of the temperature of cold water above the first temperature; stopping the chilling operation of the chiller in the event of the temperature of cold water below the second temperature; and enabling the chilling operation of the chiller in the event of the temperature of cold water above the second temperature.

Preferably, the first temperature is 10±10% ° C.; and the second temperature is 12±10% ° C.

The present invention has the following advantages: 1) rapid switching between cold water and hot water can be achieved; 2) when cold water or alternate cold and hot water is utilized to clean the anus, the pain caused by hemorrhoids can be alleviated; 3) if the anus is cleaned by using cold water or alternating cold and hot water for a long time, a good treatment effect on the hemorrhoids can be produced.

DETAILED DESCRIPTION OF THE INVENTION

Figure 1:
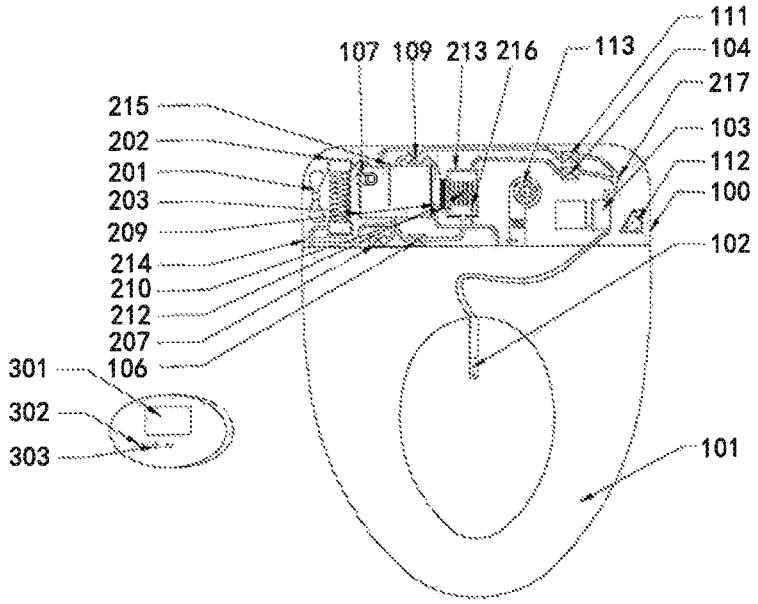
FIG. 1 is a schematic structure diagram of an internal water chiller of embodiment 1 of the present invention.

It is to be appreciated that "top", "bottom", "left", "right", "up", "down", "leftwards", "rightwards", etc., as used herein, are directional terms are descriptions with regard to non-limiting orientations indicated in the accompanying drawings. The terms "inward", "outward", "inner", "outer", "inside" and "outside" used herein refer to ranges relative to the center of a member, unless stated otherwise. For example, with reference to the axis of a motor, "inner" and "inside" mean positions or orientations closer or pointing to the axis of the motor, and "outer" and "outside" mean being further away from the center position of the motor. In addition, the terms "horizontal", "vertical" and "overhanging" do not mean requiring absolute horizontal or overhanging of a member, which may slightly tilt. For example, "horizontal" just refers to that the direction is more horizontal relative to "vertical" and does not mean that the structure is to be fully horizontal, which, however, may slightly tilt.

Referring to FIG. 1 to FIG. 7, an electronic toilet switchable between cold water and hot water in the present invention includes: a controller 112, a water spraying cleaner 102, a cold-water pipe 1 for supplying cold water, a hot-water pipe 2 for supplying hot water, a cold water electromagnetic valve 104 disposed on the cold-water pipe 2, a hot water electromagnetic valve 111 disposed on the hot-water pipe 2, and a booster pump having a water inlet communicating with a water outlet of the cold water electromagnetic valve 104 and a water outlet of the hot water electromagnetic valve 111 and a water outlet connected to the cleaner.

Referring to FIG. 8 and FIG. 9, FIG. 12 and FIG. 13, and FIG. 16 to FIG. 23, another electronic toilet switchable between cold water and hot water in the present invention includes: a controller 112; a water spraying cleaner 102; a cold-water pipe 1 for supplying cold water; a hot-water pipe 2 for supplying hot water; a water selector valve for receiving and discharging cold water from the cold-water pipe 1 or receiving and discharging hot water from the hot-water pipe 2 under the control of the controller 102, the water selector valve having a hot-water inlet connected to the hot-water pipe 2, a cold-water inlet connected to the cold-water pipe, and a water outlet for discharging cold water or hot water; and a switching unit for controlling cold water in the cold-water pipe and/or hot water in the hot-water pipe to be sprayed via the water spraying cleaner.

Preferably, the switching unit is a booster pump 103 connected between the water outlet of the water selector valve and the water spraying cleaner via a pipe, or a water inlet valve 406 for connecting/disconnecting the cold-water pipe and/or the hot-water pipe.

Figure 10:
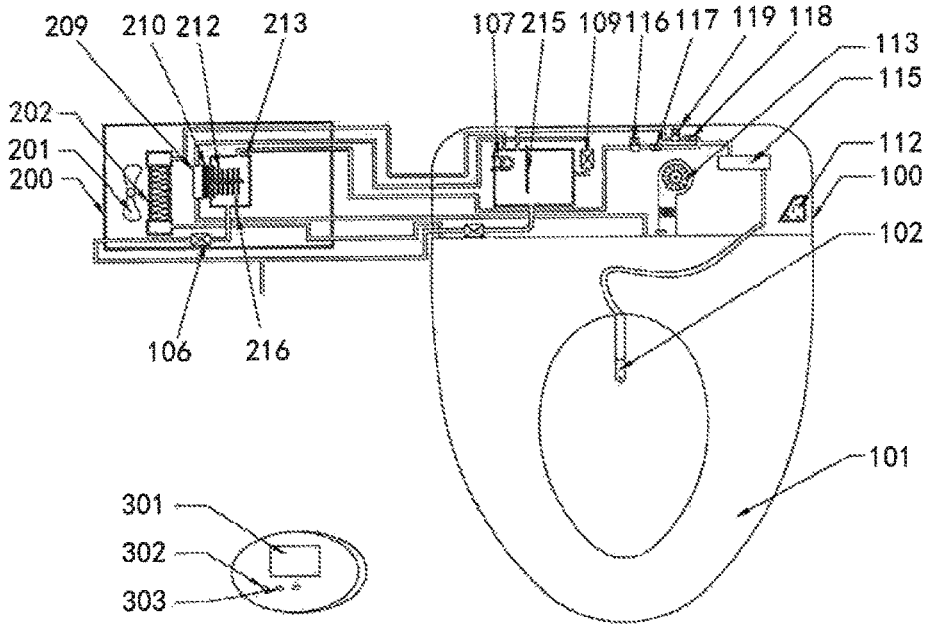
FIG. 10 is a schematic structure diagram of embodiment 5 of the present invention.
Figure 11:
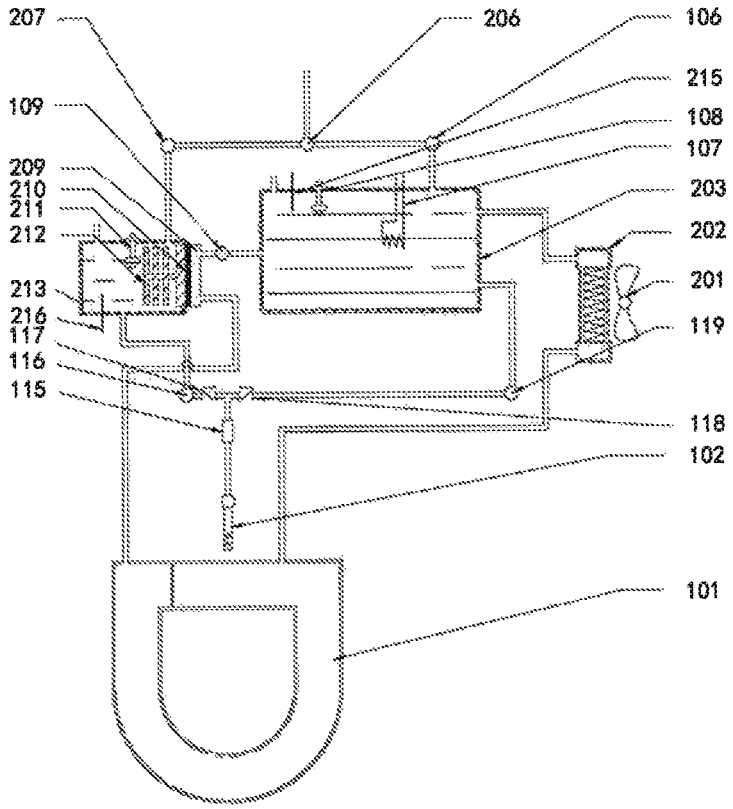
FIG. 11 is a pipe connection diagram of embodiment 5 of the present invention.

Referring to FIG. 10 and FIG. 11, yet another an electronic toilet switchable between cold water and hot water in the present invention includes a controller 112, water spraying cleaner 102, a cold-water pipe 1 for supplying cold water, a hot-water pipe 2 for supplying hot water, a cold water one-way booster pump unit 116 to 117 connected to the cold-water pipe and controlled by the controller, and a hot water one-way booster pump unit 118 to 119 connected to the hot-water pipe and controlled by the controller, wherein the water spraying cleaner 102 communicates with a water outlet of the cold water one-way booster pump unit and a water outlet of the hot water one-way booster pump unit.

Referring to FIG. 10 and FIG. 11, the above cold water one-way booster pump unit includes a cold-water booster pump 116 connected with a water inlet thereof to the cold-water outlet pipe and controlled by the controller, and a cold-water check valve 117 connected with a water inlet thereof to a water outlet of the cold-water booster pump. The above hot water one-way booster pump unit includes a hot water booster pump 119 connected with a water inlet thereof to the hot water outlet pipe and controlled by the controller, and a hot water check valve 118 connected with a water inlet thereof to a water outlet of the hot water booster pump, wherein a water outlet of the cold-water check valve and a water outlet of the hot water check valve are connected to a water inlet of the water spraying cleaner via pipes.

Figure 20:
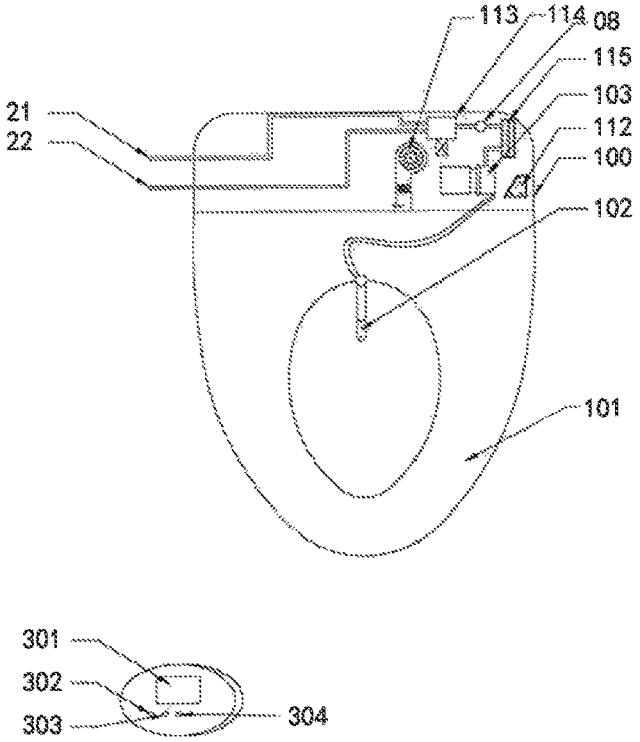
FIG. 20 is a schematic structure diagram of embodiment 9 of the present invention.
Figure 21:
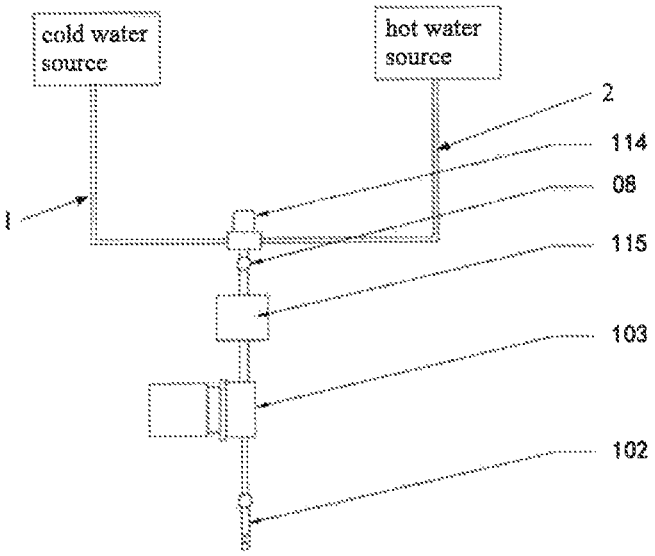
FIG. 21 is a pipe connection diagram of embodiment 9 of the present invention.

Referring to FIG. 20 and FIG. 21, the above cold-water pipe 1 and the hot-water pipe 2 are connected to an external cold-water source and an external hot water source, respectively.

Figure 5:
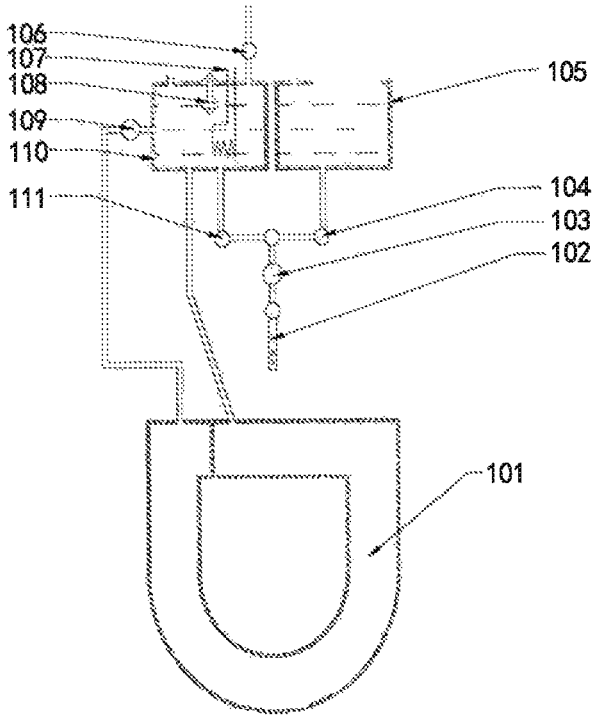
FIG. 5 is a pipe connection diagram of embodiment 2 of the present invention.
Figure 18:
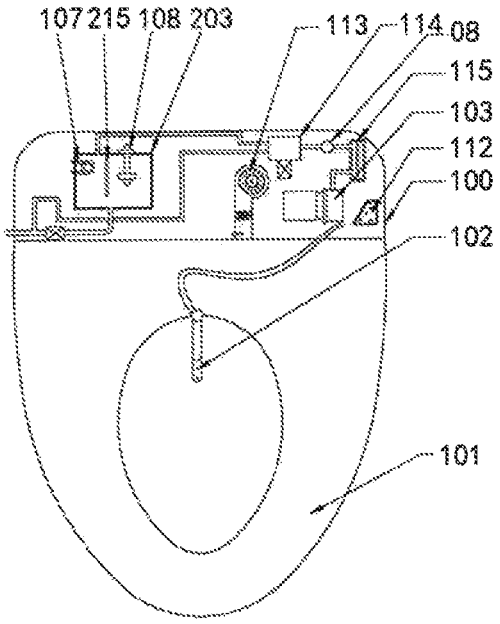
FIG. 18 is a schematic structure diagram of embodiment 8 of the present invention.
Figure 19:
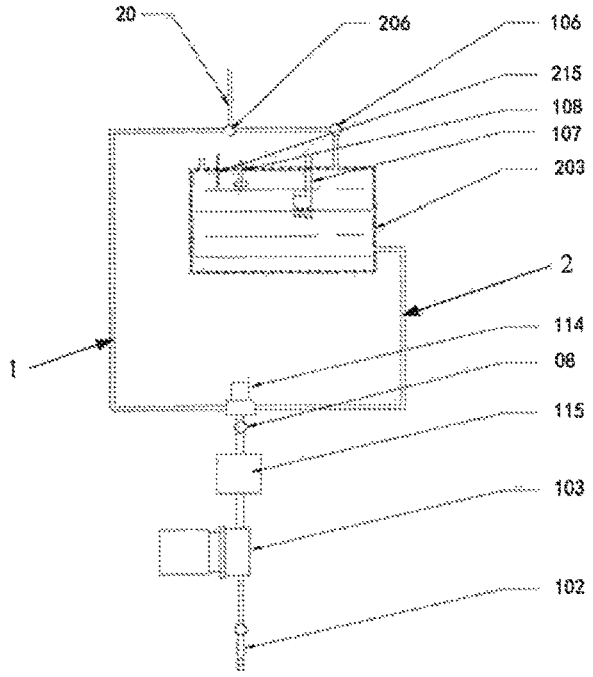
FIG. 19 is a pipe connection diagram of embodiment 8 of the present invention.

Referring to FIG. 5, FIG. 18 and FIG. 19, the above cold-water pipe 1 is connected to the external cold-water source 20 or connected to an external water source via a non-chilling cold-water tank 105; and the hot-water pipe 2 is connected to the external water source via a water heater for producing hot water.

Referring to FIG. 8 to FIG. 13, FIG. 16 and FIG. 17, the electronic toilet in the present invention also includes a water heater connected between the external cold-water source and the hot-water pipe to produce hot water, and a water chiller connected between the external hot water source and the cold-water pipe to produce cold water.

Referring to FIG. 8 to FIG. 13, and FIG. 16 and FIG. 17, the water chiller includes a cold-water tank 213, which contains the cold water therein, a sensor 216 installed in or outside the cold-water tank to directly or indirectly detect a temperature of cold water in the cold-water tank, and a chiller having a chilling part installed in or outside the cold-water tank 213 and configured to directly or indirectly chill the cold water in the cold-water tank.

Referring to FIG. 8 to FIG. 13, and FIG. 16 and FIG. 17, the above chiller is a semiconductor chilling plate 210 including a radiating surface and a chilling surface, with the chilling surface being installed in the cold-water tank or pressed against an outer wall of the cold-water tank as the chilling part. The radiating surface of the semiconductor chilling plate communicates with the water heater to transfer heat to hot water in the water heater.

Figure 6:
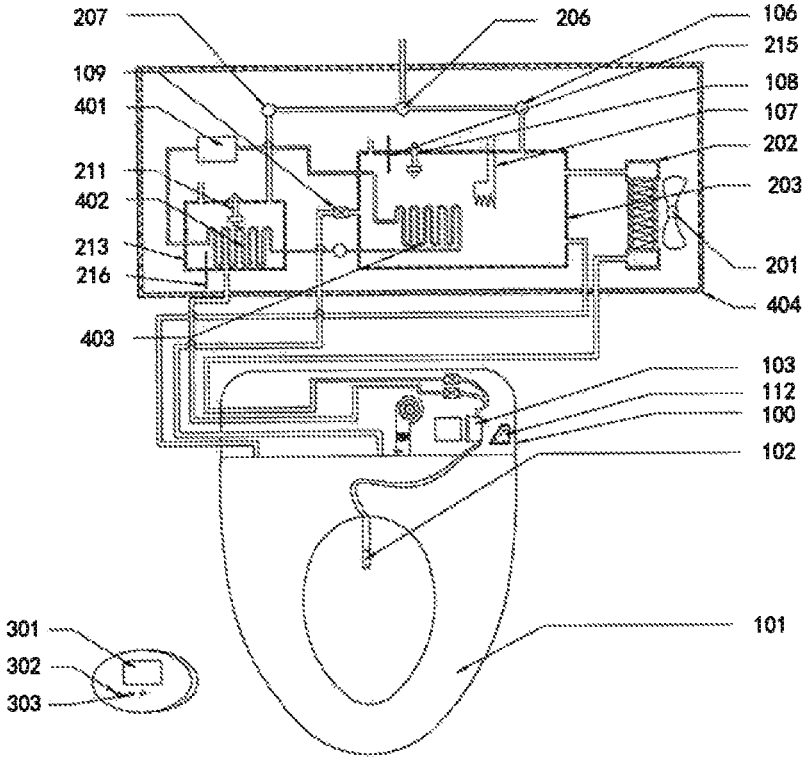
FIG. 6 is a schematic structure diagram of embodiment 3 of the present invention.
Figure 7:
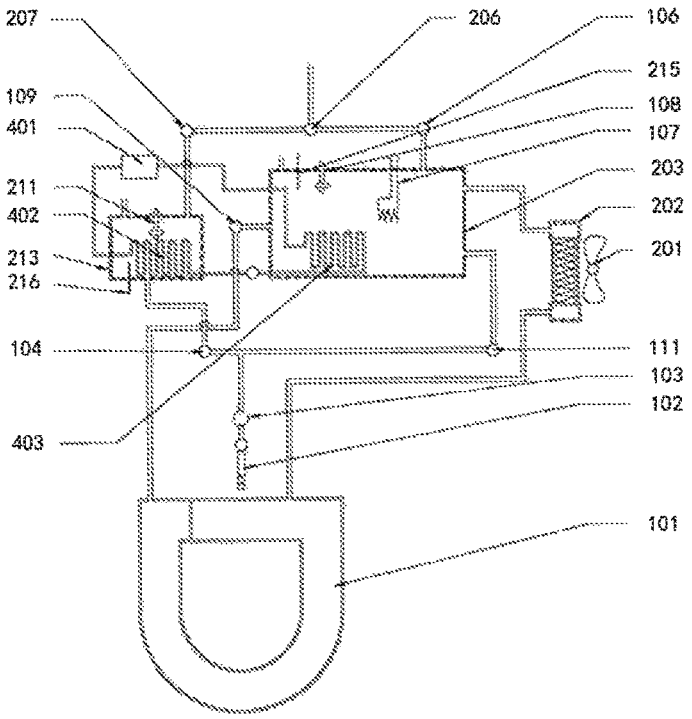
FIG. 7 is a pipe connection diagram of embodiment 3 of the present invention.

Referring to FIG. 8 to FIG. 13, and FIG. 16 and FIG. 17, the above chiller also includes a radiating fin 212 installed in the cold-water tank and pressed against the chilling surface of the semiconductor chilling plate for cold energy conduction. Referring to FIG. 6 and FIG. 7, the chiller is a chilling system including a compressor 401, an evaporator 402 and a condenser 403, wherein the evaporator is installed in the cold-water tank or pressed against the outer wall of the cold-water tank as the chilling part. It needs to be noted that the chilling system may be replaceable with the semiconductor chilling plate 210 in FIG. 8 to FIG. 13, and FIG. 16 and FIG. 17.

Referring to FIG. 6 to FIG. 13, and FIG. 16 and FIG. 17, the water heater includes a hot water tank 203, a heating element installed in or outside the hot water tank, a temperature sensor 215 installed in the hot water tank, and a water level switch 108 installed in the hot water tank.

Referring to FIG. 6 and FIG. 7, the above heating element includes the condenser 403 of the chilling system that is installed in the hot water tank or pressed against an outer wall of the hot water tank. In addition, the heating element may also include a heating tube installed in the hot water tank.

In addition, a heat sink is disposed between a pipe connecting to the hot water tank 203 and a pipe connecting to a seat having a water receiving cavity. The heat sink includes a radiator 202 and a fan 201.

Referring to FIG. 14-1, FIG. 14-2, FIG. 15-1 and FIG. 15-2, the above water selector valve includes a valve body 114.3 having the cold-water inlet, the hot-water inlet and the water outlet, and an electrically driven opening-closing component installed in the valve body and controlled by the controller to open the hot-water inlet when closing the cold-water inlet or open the cold-water inlet when closing the hot-water inlet. The electrically driven opening-closing component includes a drive element 114.1 installed on the valve body and controlled by the controller and a valve spool 114.8 installed in a cavity of the valve body and driven by the drive element. The valve spool 114.8 has a closing part for closing the cold-water inlet or the hot-water inlet.

The structure and the operating principle of the electronic toilet in the present invention will be described below in detail in conjunction with specific embodiments. It needs to be noted that the following embodiments 1 to 10 are all intended to illustrate the structure of the aforesaid electronic toilet rather than to limit the structure of the electronic toilet to a specific embodiment. For example, the chilling system including the compressor 401, the evaporator 402 and the condenser 403 illustrated by embodiment 3 as shown in FIG. 6 and FIG. 7 may be applied to other embodiments as a substitute for the semiconductor chilling plate.

Embodiment 1

As shown in FIG. 1, an electronic toilet switchable between cold water and hot water includes a controller 112, a main body 100, a seat 101 in hinged connection with the main body, and a seat cover (not shown). The electronic toilet is provided with a water spraying cleaner 102, a water chiller and a water heater. An electronic valve 111 and an electronic valve 104 are mounted on water outlet pipes of the water chiller and the water heater, respectively. The water outlet pipe of the water chiller through the electronic valve 111 joins the water outlet pipe of the water heater through the electronic valve 104 by means of a tee joint 217. The confluent pipe is connected to the water spraying cleaner 102 through a booster pump 103. The electronic toilet is switchable between cold water and hot water under the control of a wireless operator 301.

A heating tube 107 in the water heater may be omitted, and the heat of a radiating surface 210.2 of a semiconductor chilling plate may just be utilized to heat water in a hot water tank.

Figure 2:
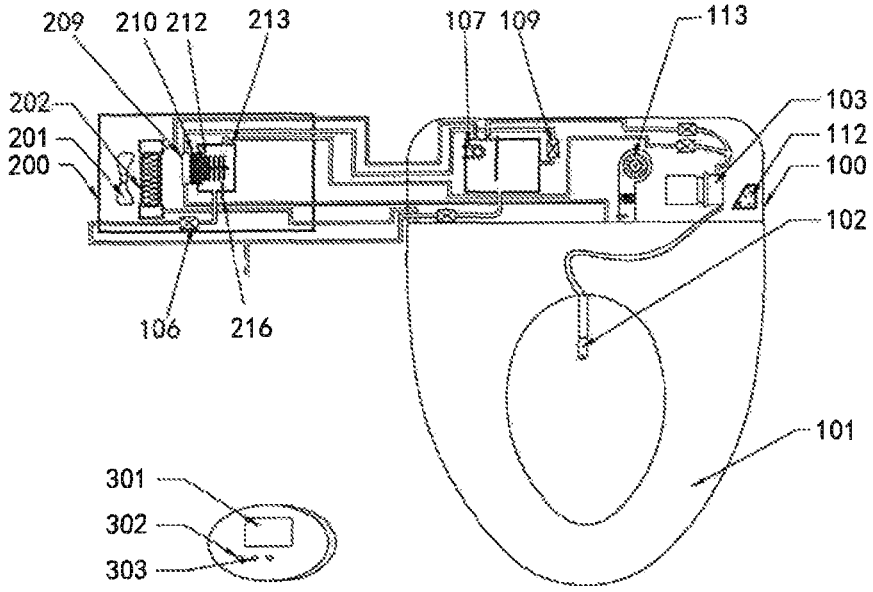
FIG. 2 is a schematic structure diagram of an external water chiller of embodiment 1 of the present invention.

FIG. 1 and FIG. 2 are two implementations of the chiller, wherein the chiller of FIG. 1 is disposed within the main body, and the chiller of FIG. 2 is disposed outside the main body.

Figure 4:
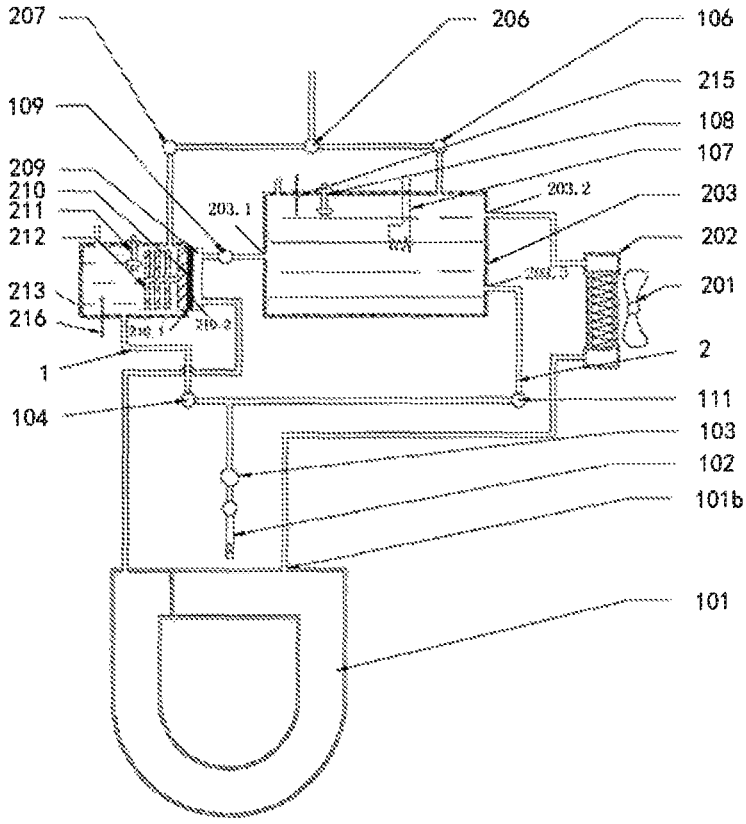
FIG. 4 is a pipe connection diagram of embodiment 1 of the present invention.

As shown in FIG. 4, the water chiller includes a cold-water tank 213, a semiconductor chilling plate 210, a radiating fin 212, a temperature sensor 216 and a water level switch 211. A chilling surface 210.1 of the semiconductor chilling plate 210 is installed within the cold-water tank 213. The radiating fin 212 is connected against the chilling surface 210.1 of the semiconductor chilling plate 210. The radiating fin 212 serves to expand the contact area of the chilling surface and water in the cold-water tank for rapid chilling. The radiating surface 210.2 of the semiconductor chilling plate 210 is connected to the water heater through a cold-water joint 209. The water level switch 211 and the temperature sensor 216 are installed within the cold-water tank 213. The water level switch 211 serves to control water replenishment to the cold-water tank 213. The temperature sensor 216 serves to detect the temperature in the cold-water tank 213. A program controller 112 controls the semiconductor chilling plate 210 to operate according to a detection signal from the temperature sensor 216.

As shown in FIG. 4, the water heater includes a hot water tank 203, a heating tube 107, a temperature sensor 215 and a water level switch 108. The radiating surface 210.2 of the semiconductor chilling plate 210 of the chiller is connected to the pipe of the water heater through the cold-water joint 209.

As shown in FIG. 4, the seat 101 has a water receiving cavity and a water inlet/outlet. A heat sink is disposed between the circulating water inlet 203.2 of the hot water tank and a connecting pipe of the seat 101, and the heat sink includes a radiator 202 and a fan 201. Two ports are provided on the radiator 202, one port connected with the seat 101 and the other port connected with the hot water tank. Also provided on the external surface of the radiator 202 is the fan 201. When the semiconductor chilling plate 210 starts chilling to bring the temperature in the hot water tank 213 to a set temperature, the fan 201 is activated, and the heat sink may rapidly take away the heat from the radiating surface 210.2 of the semiconductor chilling plate, thereby increasing the chilling speed.

As shown in FIG. 4, the pipe connection of the electronic toilet switchable between cold water and hot water is as follows: a main water inlet pipe is divided into two branches through a tee joint 206. One branch enters the cold-water tank 213 after passing through a water inlet valve 207; a pipe is connected to the electromagnetic valve 104 after passing through the water outlet of the cold-water tank 213. The pipe through the electromagnetic valve 104 joins the hot-water pipe through the tee joint 217. The confluent pipe then passes through the booster pump 103 and is finally connected to the water spraying cleaner 102. The other branch enters the hot water tank 203 after passing through a water inlet valve 106. The hot water tank is provided with a circulating water outlet 203.1, a circulating water inlet 203.2 and a water inlet 203.3 for the water spraying cleaner. A pipe is connected to a circulating water pump 109 through the circulating water outlet 203.1 of the hot water tank. The pipe is connected to the cold-water joint 209 through the circulating water pump 109. After passing through the cold-water joint 209, the pipe communicates with the seat 101, and then the pipe communicates the water outlet 101*b* of the seat 101 with the radiator 202. After passing through the radiator 202, the pipe is connected to the circulating water inlet 203.2. This process results in a circulating loop of the heat seat. The pipe is then led out from the water inlet 203.3 for the water spraying cleaner in the hot water tank 203 to communicate the electromagnetic valve 104 with the hot water tank 203. The pipe through the electromagnetic valve 104 joins the cold-water pipe through the tee joint 217, and the confluent pipe then passes through the booster pump 103 and is finally connected to the water spraying cleaner 102.

In the operating process, when the hot water tank 203 and the cold-water tank 213 are both below set temperatures, the water in the hot water tank comes into contact with the radiating surface 210.2 of the semiconductor chilling plate after passing through the circulating water outlet 203.1 and the cold-water joint 209. The water in the hot water tank can be heated by using the heat from the radiating surface 210.2 of the semiconductor chilling plate 210, and meanwhile, the water flowing from the radiating surface 210.2 of the semiconductor chilling plate will take away the heat of the radiating surface 210.2, thereby increasing the chilling speed of the cold-water tank 213. When the hot water tank 203 is at the set temperature and the cold-water tank 213 is below the set temperature, the fan 201 is activated, and the radiator 202 in the circulation loop of the water heating seat rapidly takes away the heat generated by the radiating surface 210.2 of the semiconductor chilling plate, allowing rapid chilling. In this process, the heat dissipated by the heat sink is more than the heat generated by the semiconductor chilling plate 201.

As shown in FIG. 1 and FIG. 2, the wireless operator 301 is provided with two function keys: a cold-water key 303 for controlling spraying of cold water and a cold/hot water key 302 for controlling alternate spraying of cold water and hot water. When the cold-water key 303 of the wireless operator 301 is pressed down, the electromagnetic valve 104 is closed and the electromagnetic valve 111 is opened allowing cold water to be sprayed from the water spraying cleaner 102. When the cold/hot water key 302 is pressed down, step 1 is performed first: opening the electromagnetic valve 111 and closing the electromagnetic valve 104; and then step 2 is performed: closing the electromagnetic valve 111 and opening the electromagnetic valve 104. Subsequently, circulating actions are carried out in accordance with step 1 and step 2 to realize rapid alternating of hot water and cold water, allowing cold water and hot water to be alternately sprayed from the water spraying cleaner 102. If the anus is cleaned by using cold water or alternately cleaned by using cold water and hot water for a long time, a good treatment effect on the hemorrhoids can be produced.

Embodiment 2

Figure 3:
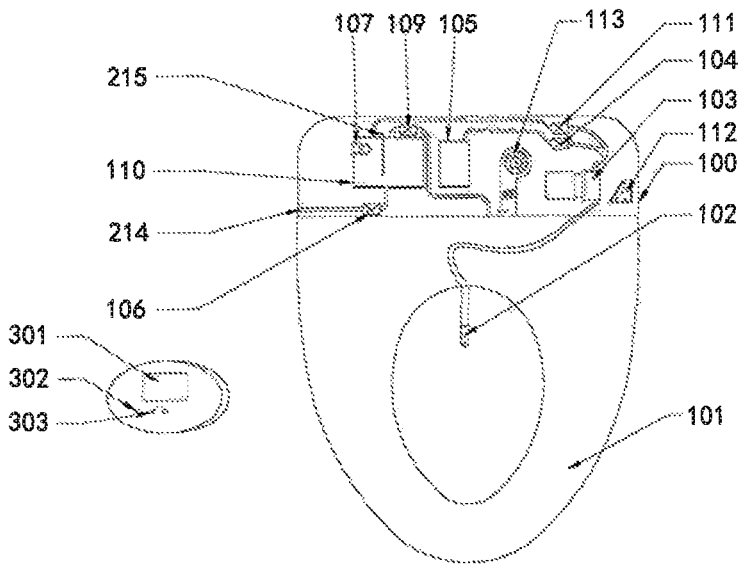
FIG. 3 is a schematic structure diagram of embodiment 2 of the present invention.

FIG. 3 and FIG. 5 are a structure diagram and a pipe connection diagram of embodiment 2 of the electronic toilet switchable between cold water and hot water, respectively. Compared to embodiment 1, water tank 105 is a cavity communicating with the outside of the main body, and such electronic elements of chilling, water level, temperature sensing and the like are not needed within the water tank.

When a user needs cold water for cleaning, cold water is injected into the water tank 105 in advance.

Embodiment 3

FIG. 6 and FIG. 7 a structure diagram and a pipe connection diagram of embodiment 3 of the electronic toilet switchable between cold water and hot water. Compared to embodiment 1, the semiconductor chilling plate is replaced with a compressor chilling system, and an evaporator 402 of the compressor chilling system is immersed in the cold-water tank 213 for chilling instead of the radiating fin 212. The evaporator 402 may also enclose the cold-water tank to conduct its cold energy to cold water in the cold-water tank 213. The condenser 403 of the compressor chilling system is immersed in the hot water tank 203 for heating. The condenser 403 may also enclose the wall of the hot water tank to conduct its heat to hot water in the hot water tank 203. The condenser 403 may also be placed away from the hot water tank 203 and its heat is dissipated into the air without heating the hot water tank. The heating tube 107 in the water heater may be omitted, and the heat of the condenser 403 of the compressor chilling system may just be utilized to heat water in the hot water tank.

Embodiment 4

Figure 8:
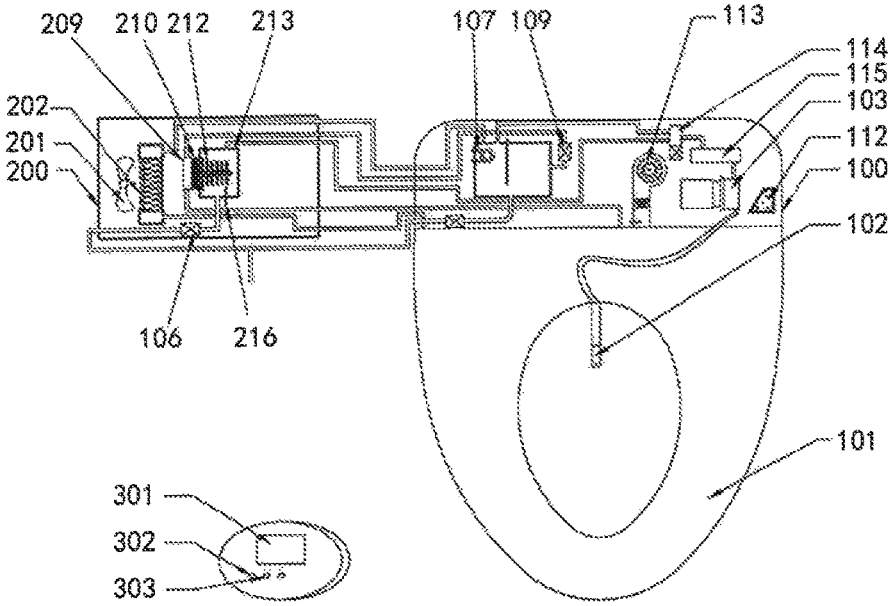
FIG. 8 is a schematic structure diagram of embodiment 4 of the present invention.
Figure 9:
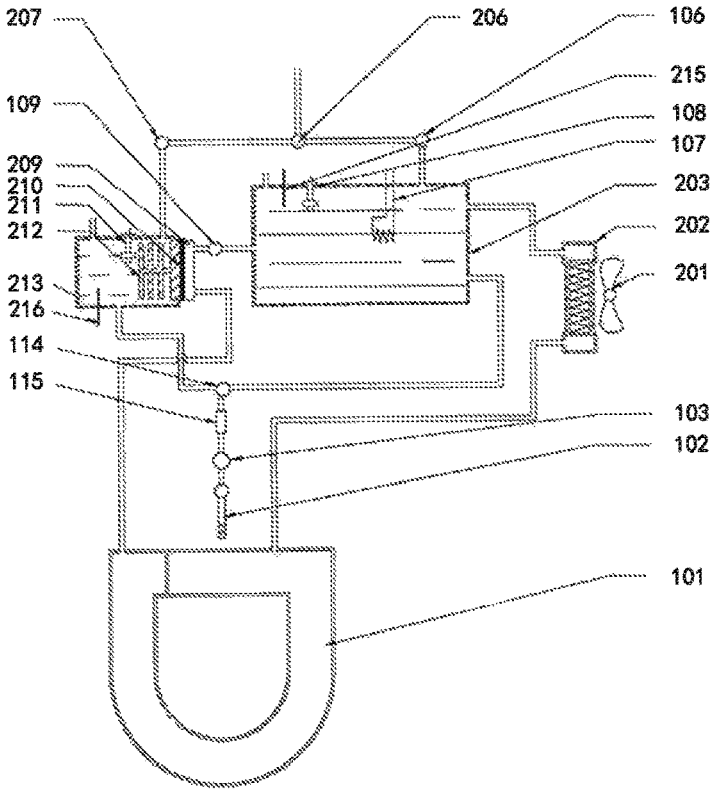
FIG. 9 is a pipe connection diagram of embodiment 4 of the present invention.

FIG. 8 and FIG. 9 are structure diagram and a pipe connection diagram of embodiment 4 of the electronic toilet switchable between cold water and hot water. Compared to embodiment 1, the electromagnetic valve 104 and the electromagnetic valve 111 are replaced by a water selector valve 114. The water selector valve 114 is employed to realize switching between cold water and hot water. An outlet of the water selector valve 114 is connected to the booster pump 103. Moreover, a sterilizer 115 is added to kill bacteria in pipes. In case of no need for sterilization, the sterilizer may be omitted. The sterilizer 115 may be disposed on the pipe between the water selector valve 114 and the booster pump 103.

Figures 1, 14:
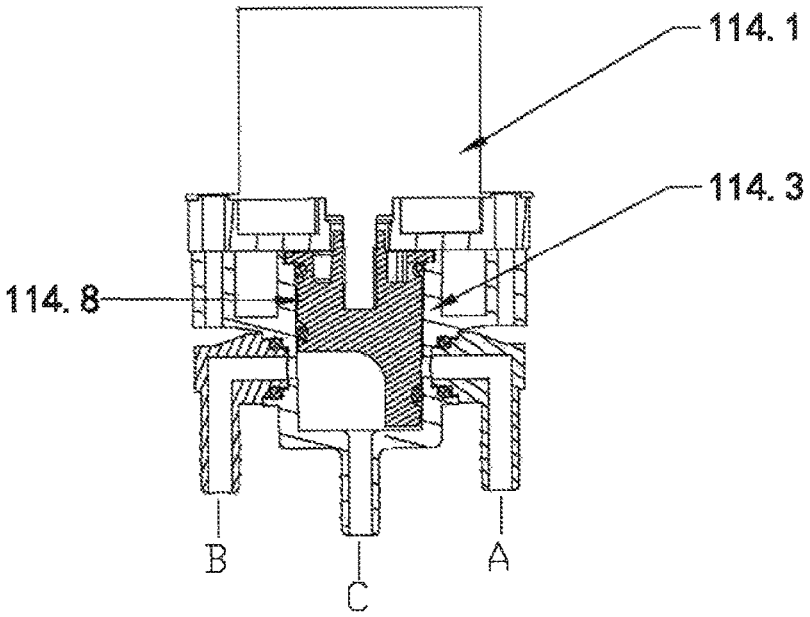
FIG. 14 is a first schematic structure diagram of a water selector valve.
Figures 2, 14:
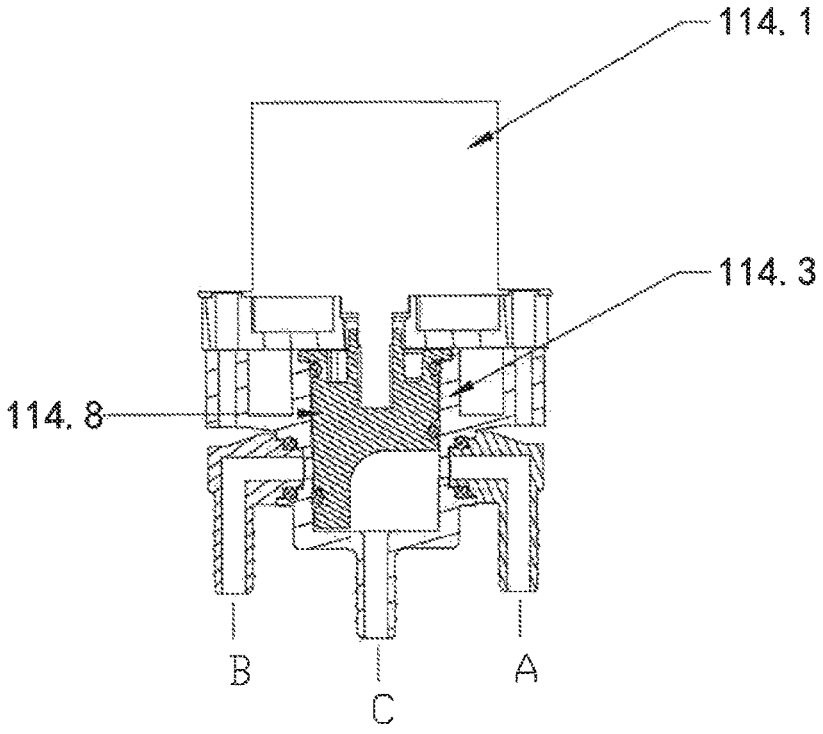

FIG. 14 is a structure of the water selector valve 114. An opening-closing component 114.8 is driven by a motor 114.1 to rotate to realize connection of an inlet B and an outlet C and disconnection of an inlet A and an outlet C (as shown in FIG. 14-1), or switch to disconnection of the inlet B and the outlet C and connection of the inlet A and the outlet C (as shown in FIG. 14-2). The opening-closing component may also rotate to allow simultaneous connection of the inlet A, the inlet B and the outlet C. Also, the size of the inlet cross-sections of the inlet A and the inlet B can be adjusted according to a desired temperature, thereby achieving adjustment of the flow proportions of the inlet A and the inlet B and realizing that the water temperature of the outlet C meets a set requirement. The opening-closing component can be configured in the form of a column, in the form of a butterfly plate of a butterfly valve, or in the form of a ball of a ball valve.

Figures 1, 15:
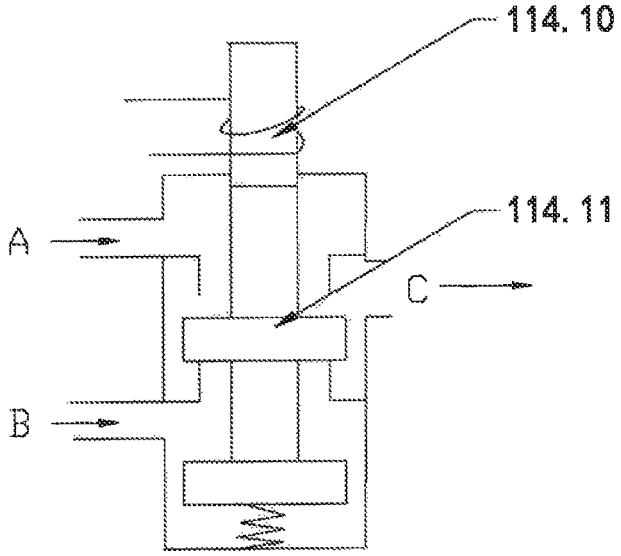
FIG. 15 is a second schematic structure diagram of a water selector valve.
Figures 2, 15:
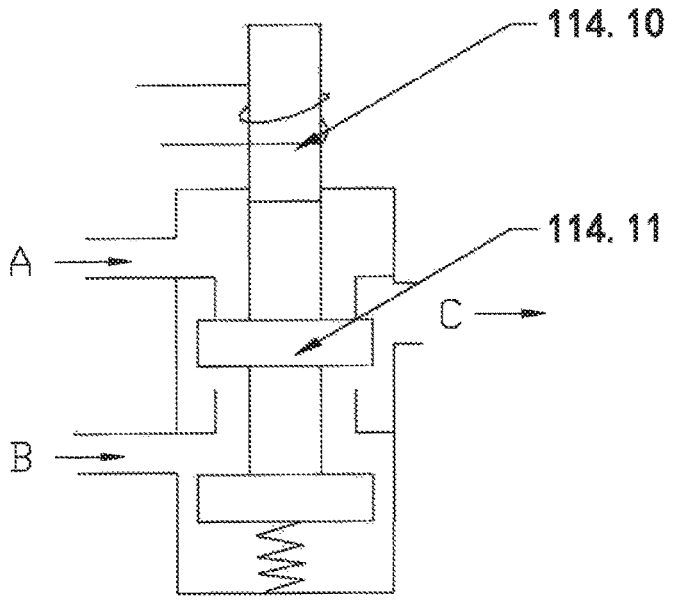

FIG. 15 is another structure of the water selector valve 114. An electromagnet 114.10 is employed to drive the opening-closing component 114.11 to reciprocate, thereby achieving connection of the inlet A and the outlet C and disconnection of the inlet B and the outlet C (as shown in FIG. 15-1), or switch to disconnection of the inlet A and the outlet C and connection of the inlet B and the outlet C (as shown in FIG. 15-2). The opening-closing component may also rotate to allow simultaneous connection of the inlet A, the inlet B and the outlet C. Also, the size of the inlet cross-sections of the inlet A and the inlet B can be adjusted according to a desired temperature, thereby achieving adjustment of the flow proportions of the inlet A and the inlet B and realizing that the water temperature of the outlet C meets a set requirement. The electromagnet 114.10 in FIG. 15 may be replaced with a motor to drive a cam to rotate, thereby driving the opening-closing component 114.11 to reciprocate, and may also be replaced with a motor to drive a gear to thereby drive a rack, allowing the opening-closing component 114.11 to reciprocate.

A wireless operator 301 is provided with two function keys: a cold-water key 303 for controlling spraying of cold water and a cold/hot water key 302 for controlling alternate spraying of cold water and hot water. When the cold-water key 303 of the wireless operator 301 is pressed down, the water selector valve 114 gates cold water, allowing cold water to be sprayed from the water spraying cleaner 102. When the cold/hot water key 302 is pressed down, step 1 is performed first: the water selector valve 114 gates cold water, and then step 2 is performed: the water selector valve 114 gates hot water. Subsequently, circulating actions are carried out in accordance with step 1 and step 2 to realize rapid alternating of hot water and cold water, allowing cold water and hot water to be alternately sprayed from the water spraying cleaner 102. During water spraying, the booster pump 103 keeps on operating.

Embodiment 5

FIG. 10 and FIG. 11 are a structure diagram and a pipe connection diagram of embodiment 5 of the electronic toilet switchable between cold water and hot water, respectively. Compared to embodiment 1, electronic toilet switchable between cold water and hot water, the electromagnetic valve 104 and the electromagnetic valve 111 are replaced by a booster pump 116 and a booster pump 119 with the booster pump 103 being omitted, and a check valve 117 and a check valve 118 are added. Moreover, a sterilizer 115 is added to kill bacteria in pipes. When the booster pump 116 operates, it draws cold water in the cold-water tank 213 such that the cold water is finally sprayed from the water spraying cleaner 102 through the check valve 117 and the sterilizer 115. The check valve 118 serves to prevent the cold water from flowing back to the hot water tank 203 via a pipe. When the booster pump 119 operates, it draws hot water in the hot water tank 203 such that the hot water is finally sprayed from the water spraying cleaner 102 through the check valve 118 and the sterilizer 115. The check valve 117 serves to prevent the hot water from flowing back to the cold-water tank 213 via a pipe. In case of no need for sterilization, the sterilizer may be omitted.

A wireless operator 301 is provided with two function keys: a cold-water key 303 for controlling spraying of cold water and a cold/hot water key 302 for controlling alternate spraying of cold water and hot water. When the cold-water key 303 of the wireless operator 301 is pressed down, the booster pump 116 is powered on to operate, allowing cold water to be sprayed from the water spraying cleaner 102. When the cold/hot water key 302 is pressed down, step 1 is performed first: the booster pump 116 is powered on to operate and the booster pump 119 is powered off; and then step 2 is performed: the booster pump 119 is powered on to operate. Subsequently, circulating actions are carried out in accordance with step 1 and step 2 to realize rapid alternating of hot water and cold water, allowing cold water and hot water to be alternately sprayed from the water spraying cleaner 102.

Embodiment 6

Figure 12:
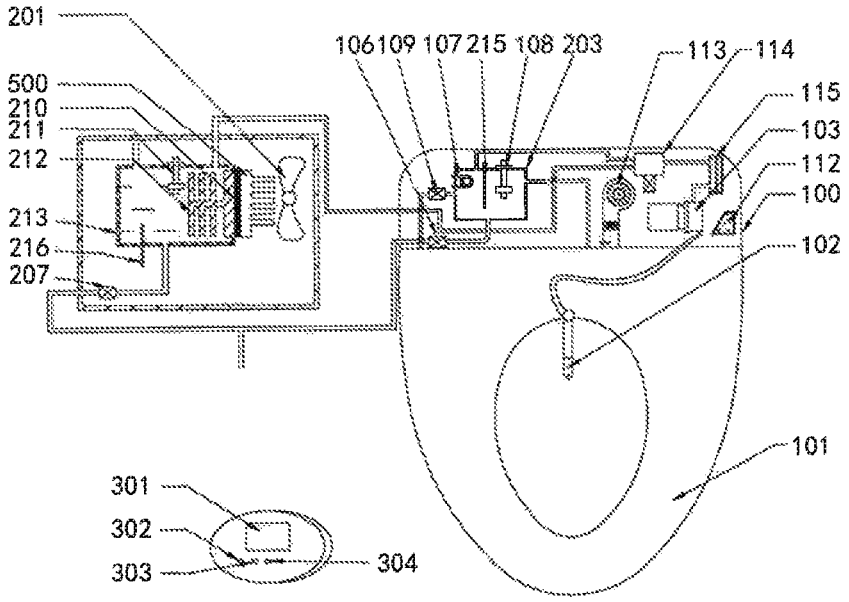
FIG. 12 is a schematic structure diagram of embodiment 6 of the present invention.
Figure 13:
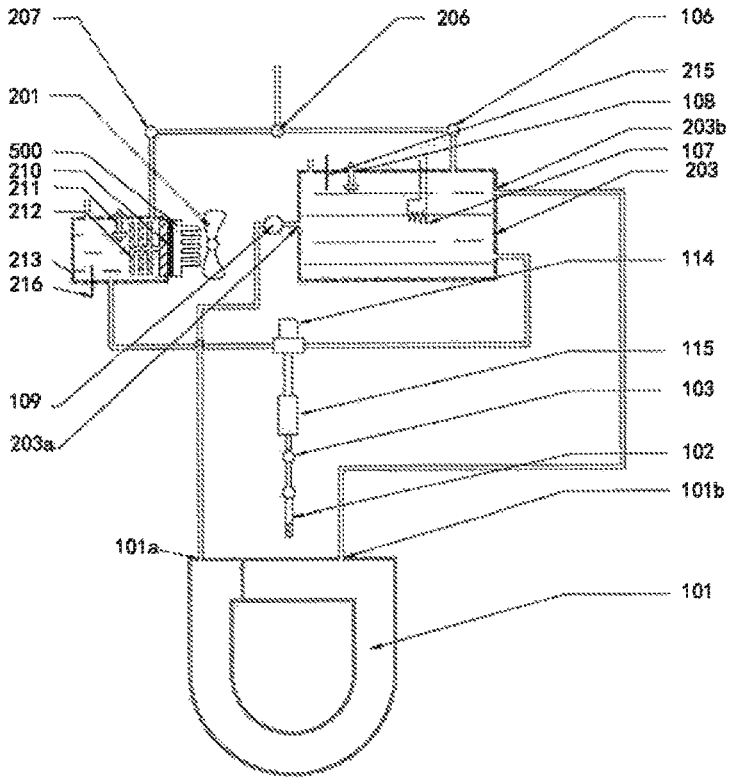
FIG. 13 is a pipe connection diagram of embodiment 6 of the present invention.

FIG. 12 and FIG. 13 are a structure diagram and a pipe connection diagram of embodiment 6 of the electronic toilet switchable between cold water and hot water, respectively. Compared to embodiment 1, the radiator 202 is replaced with a radiator 500, and the cold-water joint 209 is omitted. The radiator 500 is pressed against the heating surface 210.2 of the semiconductor chilling plate 210.2, and a circulating water pump 109 is connected to the water inlet 101*a* of the seat. The water outlet 101*b* of the seat is connected to the water inlet 203*b* of the hot water tank.

While the seat 101 serves as a part of the output pipe in the figures of each of the above embodiments, the pipe may not pass through the seat 101.

Embodiment 7

Figure 16:
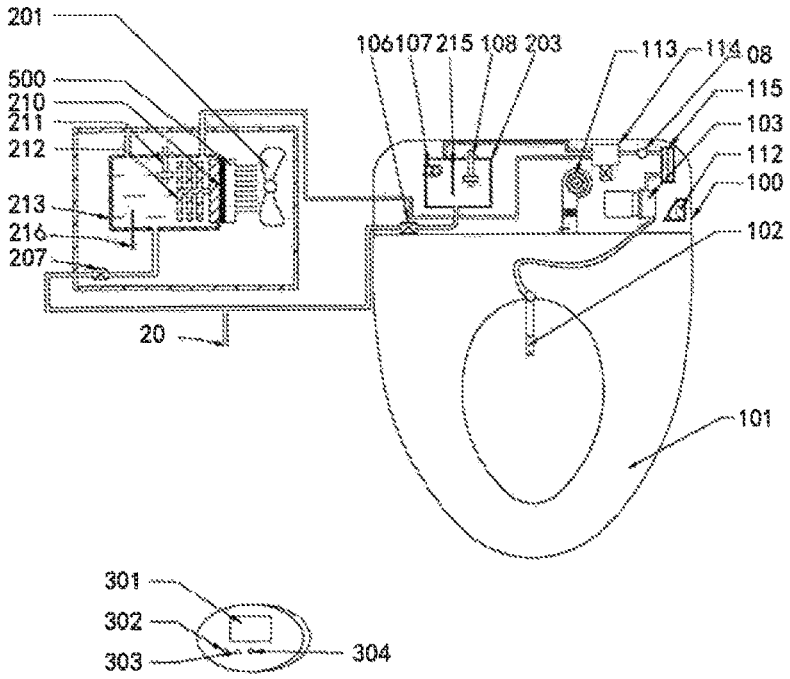
FIG. 16 is a schematic structure diagram of embodiment 7 of the present invention.
Figure 17:
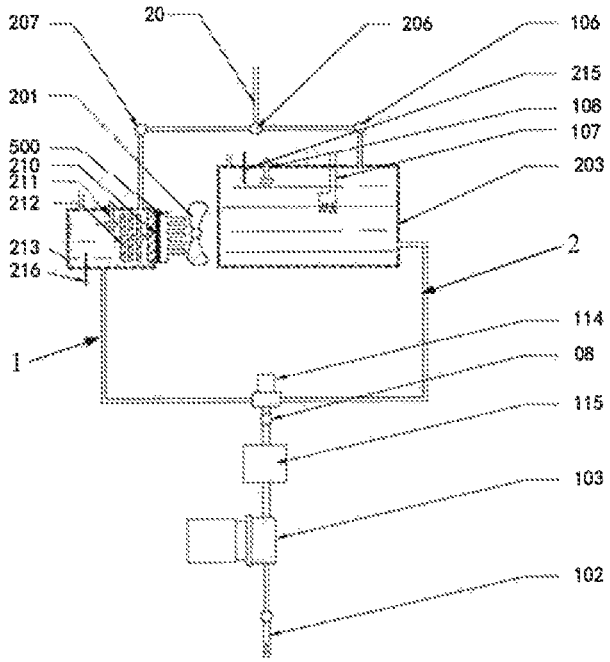
FIG. 17 is a pipe connection diagram of embodiment 7 of the present invention.

FIG. 16 and FIG. 17 are a structure diagram and a pipe connection diagram of embodiment 7 of the electronic toilet switchable between cold water and hot water, respectively. This embodiment differs from embodiment 6 in that the circulating water pump 109 and the p pipe connected the water outlet 203*a* of the hot water tank and the water inlet 101*a* of the seat and the connecting pipe between the water outlet 101*b* of the seat and the water inlet 203*b* of the hot water tank 203 in embodiment 6 are omitted. Besides, the reference numeral 20 in the figures indicates an external cold-water source, such as tap water.

In addition, a water flow sensor 08 and a sterilizer 115 may be disposed on the pipe between a water changeover valve 114 and a booster pump 103.

Embodiment 8

FIG. 18 and FIG. 19 are a structure diagram and a pipe connection diagram of embodiment 8 of the electronic toilet switchable between cold water and hot water, respectively. This embodiment differs from embodiment 7 in that the water chiller in embodiment 7 is omitted. The water inlet of the cold-water pipe 1 is directly connected to an external cold-water source 20 and the water outlet of the same is connected to the hot-water inlet of the water selector valve 114.

This embodiment involves use of the external cold-water source to supply cold water, thereby reducing the manufacturing cost with a disadvantage of unadjustable temperature of the cold water.

Embodiment 9

FIG. 20 and FIG. 21 are a structure diagram and a pipe connection diagram of embodiment 9 of the electronic toilet switchable between cold water and hot water, respectively. This embodiment differs from embodiment 8 in that the water heater in embodiment 8 is omitted. That is, the water inlet of the hot-water pipe 2 is directly connected to an external hot water source 22 and the water outlet of the same is connected to the cold-water inlet of the water selector valve 114.

This embodiment involves separate supply of cold water and hot water from an external cold-water source and an external hot water source, thereby respective use of the external cold-water source to supply cold water, thereby reducing the manufacturing cost with a disadvantage of unadjustable temperatures of the cold water and the hot water.

Embodiment 10

Figure 22:
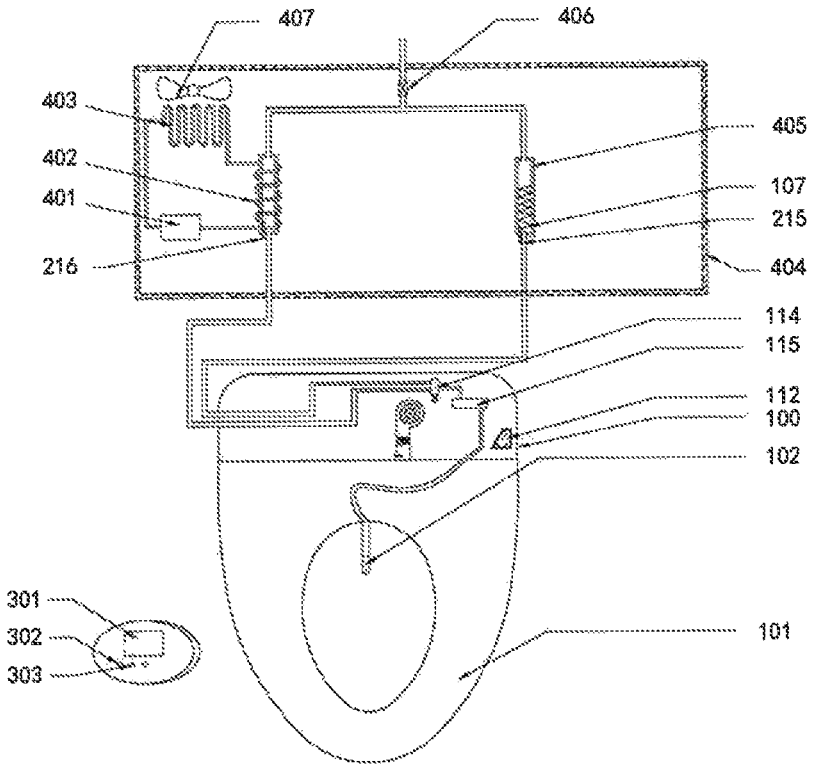
FIG. 22 is a schematic structure diagram of embodiment 10 of the present invention.
Figure 23:
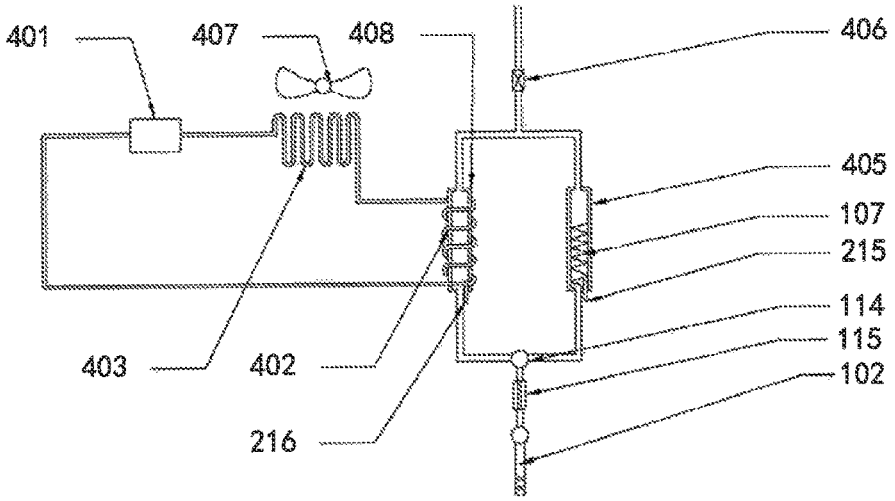
FIG. 23 is a pipe connection diagram of embodiment 10 of the present invention.

FIG. 22 and FIG. 23 are a structure diagram and a pipe connection diagram of embodiment 10 of the electronic toilet switchable between cold water and hot water, respectively. This embodiment differs from embodiment 3 in that: the hot water tank 203 and the cold-water tank 213 in embodiment 3 are replaced with a hot water generator 408 and a cold-water generator 405 with the water level switch 211 in the cold-water tank and the water level switch 108 hot water tank in embodiment 3 being omitted. The electromagnetic valve 111 and the electromagnetic valve 104 are replaced with a water selector valve 114. The electromagnetic valve 111 and the electromagnetic valve 104 are replaced with a water inlet valve 406. The booster pump 103 is omitted. The water inlet valve 406 may also be disposed externally. This embodiment involves that cold water and hot water are produced by the hot water generator 408 and the cold-water generator 405, respectively, and the operating power of a compressor 401 and a heating tube 107 is decided according to differences between temperatures returned by a sensor 216 and a sensor 215 and set temperatures. The operating power of the compressor 401 and the heating tube 107 is higher with greater temperature differences. No water level switch is disposed in the cold-water generator 405 and the hot water generator 408. Instead, the hot water generator and the cold-water generator are filled with tap water by the pressure of the tap, and then the water is converged at the water selector valve. This embodiment omits the booster pump 103, and the operating water pressure of the water spraying cleaner 102 completely depends on the water pressure.

This embodiment has the advantages that no water tank unit is provided so that the space can be saved, and without the water tank, there is no need to store water and preserve heat so that the energy can be saved. However, it has a disadvantage that the operating water pressure of the water spraying cleaner 102 cannot be guaranteed when the pressure of the tap water is low.

A wireless operator 301 is provided with two function keys: a cold-water key 303 for controlling spraying of cold water and a cold/hot water key 302 for controlling alternate spraying of cold water and hot water. When the cold-water key 303 of the wireless operator 301 is pressed down, the water inlet valve 406 is opened, and the water selector valve 114 gates cold water and disconnects hot water, allowing cold water to be sprayed from the water spraying cleaner 102. When the cold/hot water key 302 is pressed down, the water inlet valve 406 is opened, and step 1 is performed first: the water selector valve 114 gates cold water and disconnects hot water; and then step 2 is performed: the water selector valve 114 gates hot water and disconnects cold water. Subsequently, circulating actions are carried out in accordance with step 1 and step 2 to realize rapid alternating of hot water and cold water, allowing cold water and hot water to be alternately sprayed from the water spraying cleaner 102.

In another aspect, the present invention also provides two methods of controlling the electronic toilet switchable between cold water and hot water. An electronic toilet to which the first method is applicable includes: a cold-water pipe 1 for supplying cold water; a hot-water pipe 2 for supplying hot water, a switching unit for controlling the cold-water pipe or the hot-water pipe to supply water (e.g., a booster pump 116 disposed on the cold-water pipe 1 and a booster pump 119 disposed on the hot-water pipe 2 as shown in FIG. 11; or a booster water pump 103 disposed behind the water selector valve 114 as shown in FIG. 8 and FIG. 9, FIG. 12 and FIG. 13, and FIG. 16 to FIG. 21; or a water inlet valve as shown in FIG. 22 and FIG. 23); a water selector valve 114 for selecting water supply from the cold-water pipe and the hot-water pipe; a water spraying cleaner for cleaning anus with cold water or hot water selected by the water selector valve 114; and a controller for controlling the water selector valve and the switching unit.

The first method of controlling an electronic toilet switchable between cold water and hot water in the present invention includes the following steps: the controller obtaining a temperature of cold water supplied from the cold-water pipe when receiving a cleaning instruction from a user, the controller determining open time and close time for the switching unit according to the obtained temperature of cold water; the controller controlling the switching unit to be opened according to the determined open time for the switching, allowing cold water from the cold-water pipe to be sprayed via the water spraying cleaner; and the controller stopping the switching unit from operating according to the determined close time for the switching unit after expiration of the open time for the switching unit, to prevent cold water or hot water from being sprayed via the water spraying cleaner in the close time for the switching unit.

The step of the controller determining the open time and the close time for the switching unit according to the obtained temperature of cold water includes: the controller obtaining the temperature of cold water according to information of detecting the temperature of cold water from a temperature sensor; and the controller determining the open time and the close time for the switching unit that correspond to the temperature of cold water by looking up a prestored correspondence list containing a correspondence of temperatures of water, and open time and close time for the switching unit.

The lower the temperature of cold water is, the shorter the open time and the close time of the switching unit are.

Preferably, after controlling the switching unit to alternately operate and stop according to the open time for the switching unit and the close time for the switching unit that correspond to the temperature of cold water for a number of times, the controller stops water supply from the cold-water pipe by controlling the switching unit.

Preferably, the temperature of cold water is greater than or equal to 0° C. and less than or equal to 43° C.

Preferably, the correspondence of temperatures of water, and open time and close time for the switching unit in the correspondence list includes:

| Temperature of Cold-Water (° C.) | Pressure Boost Operating Time for Booster Pump (S) | Stop Time for Booster Pump (S) |
|---|---|---|
| 0-7.9 | 5 ± 10% | 2 ± 10% |
| 8-9.9 | 6 ± 10% | 3 ± 10% |
| 10-11.9 | 7 ± 10% | 4 ± 10% |
| 12-13.9 | 8 ± 10% | 5 ± 10% |
| 14-15.9 | 9 ± 10% | 5 ± 10% |
| 16-17.9 | 10 ± 10% | 5 ± 10% |
| 18-43 | 15 ± 10% | 5 ± 10% |

Preferably, the switching unit is a booster pump connected between the water outlet of the water selector valve and the water spraying cleaner via a pipe, and the open time for the switching unit is operating time for the booster pump while the close time for the switching unit is stop time for the booster pump.

An electronic toilet to which the second method is applicable includes: a cold-water pipe 1 for supplying cold water; a hot-water pipe 2 for supplying hot water; a switching unit for controlling the cold-water pipe or the hot-water pipe to supply water (e.g., a booster pump 116 disposed on the cold-water pipe 1 and a booster pump 119 disposed on the hot-water pipe 2 as shown in FIG. 11; or a booster water pump 103 disposed behind the water selector valve 114 as shown in FIG. 8 and FIG. 9, FIG. 12 and FIG. 13, and FIG. 16 to FIG. 21; or a water inlet valve as shown in FIG. 22 and FIG. 23); a water selector valve 114 for selecting water supply from the cold-water pipe and the hot-water pipe; a water spraying cleaner for cleaning anus with cold water or hot water selected by the water selector valve 114; and a controller for controlling the water selector valve and the switching unit.

The second method of controlling an electronic toilet switchable between cold water and hot water in the present invention includes the following steps: the controller controlling the switching unit to allow the cold-water pipe and/or the hot-water pipe to supply water when receiving an anus cleaning instruction from a user, the controller controlling the water selector valve to alternately discharge cold water from the cold-water pipe and hot water from the hot-water pipe during water supply from the cold-water pipe and/or the hot-water pipe, such that the water spraying cleaner alternately sprays cold water and hot water; and the controller controlling the switching unit to stop the cold-water pipe and the hot-water pipe from supplying water after the water selector valve alternately discharges cold water and hot water for a number of times.

Preferably, the switching unit is a booster pump connected between the water outlet of the water selector valve and the water spraying cleaner via a pipe. Preferably, the step that the controller controls the switching unit to allow the cold-water pipe and/or the hot-water pipe to supply water when receiving an anus cleaning instruction from a user includes: the controller controlling the water selector valve to receive and discharge cold water from the cold-water pipe and controlling the cleaner to stretch out according to the anus cleaning instruction; and the controller enabling the booster pump to perform a pressure boost operation after the cleaner is stretched out, so that the cold water is sprayed via the water spraying cleaner.

Preferably, the controller controls the water selector valve to alternately discharge cold water and hot water during water supply from the cold-water pipe and/or the hot-water pipe, which specifically includes the controller starting a timer when cold water is sprayed via the water spraying cleaner; the controller controlling the water selector valve to disconnect the cold-water pipe and connect the hot-water pipe according to timing expiration information of the timer, allowing hot water from the hot-water pipe to be sprayed via the water spraying cleaner; and the controller starting again the timer when hot water is sprayed via the water spraying cleaner, and controlling the water selector valve to receive and discharge cold water from the cold-water pipe, allowing the cold water to be sprayed via the water spraying cleaner, thereby achieving alternate spray of cold water and hot water via the water spraying cleaner.

Preferably, when cold water from a water chiller is supplied by the cold-water pipe, the controller detects the temperature of cold water in a cold-water tank by means of a temperature sensor installed in the cold water tank, and controls a chiller to chill the water in the cold-water tank according to a detection result.

Preferably, the controller controls the chiller to chill the water in the cold-water tank according to the detection result, which specifically includes: determining whether the detected temperature of cold water is below a first temperature; stopping the chilling operation of the chiller in the event of the temperature of cold water below the first temperature; determining whether temperature of cold water is above a second temperature in the event of the temperature of cold water above the first temperature; stopping the chilling operation of the chiller in the event of the temperature of cold water below the second temperature; and enabling the chilling operation of the chiller in the event of the temperature of cold water above the second temperature.

Preferably, the first temperature is 10±10% ° C.; and the second temperature is 12±10% ° C.

The present invention includes but is not limited to the contents illustrated by the above embodiments and the figures, and any other product structures having the same substantive contents with the technical solutions of the present invention shall all fall into the scope of protection of the present invention.

The invention claimed is:

1. An electronic toilet switchable between cold water and hot water comprising:

a controller;

a water spraying cleaner;

a cold-water pipe for supplying cold water;

a hot-water pipe for supplying hot water;

a cold water one-way booster pump unit connected to the cold-water pipe and controlled by the controller; and a hot water one-way booster pump unit connected to the hot-water pipe and controlled by the controller;

wherein the water spraying cleaner communicates with a water outlet of the cold water one-way booster pump unit and a water outlet of the hot water one-way booster pump unit.

2. The electronic toilet of claim 1, characterized in that the cold water one-way booster pump unit comprises:

a cold-water booster pump having a water inlet connected to the cold-water outlet pipe and being controlled by the controller; and a cold-water check valve having a water inlet connected to a water outlet of the cold-water booster pump; and wherein the hot water one-way booster pump unit comprises:

a hot water booster pump having a water inlet connected to the hot water outlet pipe and controlled by the controller; and a hot water check valve having a water inlet connected to a water outlet of the hot water booster pump;

wherein a water outlet of the cold-water check valve and a water outlet of the hot water check valve are connected to a water inlet of the water spraying cleaner via pipes.

3. The electronic toilet of claim 1, characterized by further comprising:

a water heater connected between an external water source and the hot water pipe to produce hot water; and a water chiller connected between the external water source and the cold-water pipe to produce cold water.

4. The electronic toilet of claim 3, characterized in that the water chiller comprises:

a cold-water tank which contains the cold water therein;

a sensor installed in or outside the cold-water tank to directly or indirectly detect a temperature of cold water in the cold-water tank; and a chiller having a chilling part installed in or outside the cold-water tank and configured to directly or indirectly chill the cold water in the cold-water tank.

5. The electronic toilet of claim 4, characterized in that the chilling part is a semiconductor chilling plate comprising a radiating surface and a chilling surface, with the chilling surface being installed in the cold-water tank or clinging to an outer wall of the cold-water tank as the chilling part; and wherein the chiller further comprises a radiating fin installed in the cold-water tank and clinging to the chilling surface of the semiconductor chilling plate.

6. The electronic toilet of claim 5, characterized in that the radiating surface of the semiconductor chilling plate communicates with the water heater to transfer heat to the hot water in the water heater.

7. The electronic toilet of claim 4, characterized in that the chiller is a chilling system comprising a compressor, an evaporator and a condenser, with the evaporator being installed in the cold-water tank or clinging to the outer wall of the cold-water tank as the chilling part.

8. The electronic toilet of claim 7, characterized in that the water heater comprises:

a hot water tank;

a heating element installed in or outside the hot water tank;

a temperature sensor installed in the hot water tank; and a water level switch installed in the hot water tank.

9. The electronic toilet of claim 8, characterized in that the heating element comprises the condenser of the chilling system that is installed in the hot water tank or clinging to an outer wall of the hot water tank.

10. The electronic toilet of claim 9, characterized in that the heating element also comprises a heating tube installed in the hot water tank.

11. The electronic toilet of claim 8, characterized in that a heat sink is disposed between a pipe connecting to the hot water tank and a pipe connecting to a seat having a water receiving cavity, the heat sink comprising a radiator and a fan.

12. The electronic toilet of claim 1, further comprising a water selector valve for receiving and discharging cold water from the cold-water pipe or receiving and discharging hot water from the hot-water pipe under the control of the controller, the water selector valve comprising:

a hot-water inlet connected to the hot-water pipe;

a cold-water inlet connected to the cold-water pipe;

a water outlet for discharging cold water or hot water:

a valve body having the cold-water inlet, the hot-water inlet and the water outlet; and an electrically driven opening-closing component installed in the valve body and controlled by the controller to reduce an opening of the hot-water inlet when increasing an opening of the cold-water inlet or increase the opening of the hot-water inlet when reducing the opening of the cold-water inlet so as to control water temperature of the outlet.

13. The electronic toilet of claim 12, characterized in that the electrically driven opening-closing component comprises:

a drive element installed on the valve body and controlled by the controller; and a valve spool installed in a cavity of the valve body and driven by the drive element, the valve spool having a closing part for closing the cold-water inlet or the hot-water inlet.

14. A method of controlling an electronic toilet to be switchable between cold water and hot water for treating hemorrhoids, the method comprising the following steps:

receiving a cleaning instruction from a user;

obtaining a temperature of cold water supplied from a cold-water pipe upon receipt of the cleaning instruction from the user;

determining an open time and a close time for a switching unit associated with the cold-water pipe and a hot water pipe according to the obtained temperature of cold water;

controlling the switching unit to be opened according to the determined open time for the switching unit, and allowing cold water from the cold-water pipe to be sprayed upon an anus of the user via a water spraying cleaner; and closing the switching unit according to the determined close time for the switching unit after expiration of the open time for the switching unit to prevent cold water or hot water from being sprayed via the water spraying cleaner.

15. The method of claim 14, wherein the step of determining the open time and the close time for the switching unit according to the obtained temperature of cold water comprises:

obtaining the temperature of cold water from a temperature sensor connected to a controller that is configured to receive the cleaning instruction; and determining the open time and the close time for the switching unit further comprises looking up a prestored correspondence list containing a correspondence of temperatures of water, and open time and close time for the switching unit.

16. The method of claim 15, wherein a duration of the open time and the close time of the switching unit are shorted when the temperature of cold water is lower.

17. The method of claim 16, wherein the temperature of cold water is greater than or equal to 0° C. and less than or equal to 43° C.

18. The method of claim 15, wherein the correspondence of temperatures of water, and open time and close time for the switching unit are related to one another in accordance with TABLE 1.1.

19. The method of claim 14, wherein the switching unit is further defined as a booster pump and the method further comprises connecting the booster pump between a water outlet of a water selector valve and the water spraying cleaner via a pipe, and wherein the open time for the switching unit is operating time for the booster pump while the close time for the switching unit is stop time for the booster pump.

20. A method of controlling an electronic toilet to be switchable between cold water and hot water for treating hemorrhoids, the method comprising the following steps:

controlling a switching unit to selectively allow one of a cold-water pipe and a hot-water pipe to supply water when receiving an anus cleaning instruction from a user;

controlling a water selector valve to alternately discharge cold water from the cold-water pipe and hot water from the hot-water pipe during water supply from the cold-water pipe and the hot-water pipe, such that a water spraying cleaner connected to the switching unit alternately sprays cold water and hot water; and controlling the switching unit by a controller to stop a supply of water associated with the cold-water pipe and the hot-water pipe after the water selector valve alternately discharges cold water and hot water for a number of times.

21. The method of claim 20, further comprising providing the switching unit as a booster pump connected between a water outlet of the water selector valve and the water spraying cleaner via a pipe.

22. The method of claim 21, wherein the step of controlling the switching unit by the controller further comprises:

controlling the water selector valve to receive and discharge cold water from the cold-water pipe according to the anus cleaning instruction, and controlling the cleaner to stretch out; and enabling the booster pump to perform a pressure boost operation after the cleaner is stretched out, so that the cold water is sprayed via the water spraying cleaner.

23. The method of claim 20, further comprising configuring the controller to control the water selector valve to alternately discharge cold water and hot water during water supply from the cold-water pipe and/or the hot-water pipe, wherein the controller is configured to:

start a timer when cold water is sprayed via the water spraying cleaner;

control the water selector valve to disconnect the cold-water pipe and connect the hot-water pipe according to timing expiration information of the timer, and allowing hot water from the hot-water pipe to be sprayed via the water spraying cleaner; and when hot water is sprayed via the water spraying cleaner, restarting the timer, controlling the water selector valve to receive and discharge cold water from the cold-water pipe according to timing expiration information of the timer, and allowing the cold water to be sprayed via the water spraying cleaner thereby achieving alternate sprays of cold water and hot water via the water spraying cleaner.

24. The method of claim 20, wherein when cold water from a water chiller is supplied by the cold-water pipe, the controller detects the temperature of cold water in a cold-water tank by means of a temperature sensor installed in the cold water tank, and controls a chiller to chill the water in the cold-water tank according to a detection result.

25. The method of claim 24, further comprising configuring the controller to controls the chiller to chill the water in the cold-water tank according to the detection result, which specifically comprises:

determining whether the detected temperature of cold water is below a first temperature;

stopping chilling operation of the chiller in the event of the temperature of cold water below the first temperature;

determining whether temperature of cold water is above a second temperature in the event of the temperature of cold water being above the first temperature;

stopping chilling operation of the chiller in the event of the temperature of cold water below the second temperature; and enabling chilling operation of the chiller in the event of the temperature of cold water above the second temperature.

26. The method of claim 25, wherein the first temperature is 10±10% ° C., and the second temperature is 12±10% ° C.

* * * * *